United States Patent [19]

Reininga

[11] 4,358,906

[45] Nov. 16, 1982

[54] CALENDAR

[76] Inventor: Gary W. Reininga, 18960 Fernbrook Ct., Saratoga, Calif. 95070

[21] Appl. No.: 138,763

[22] Filed: Apr. 9, 1980

[51] Int. Cl.[3] ..... G09D 3/02

[52] U.S. Cl. ..... 40/107; 40/109

[58] Field of Search ..... 40/107, 109, 120; 283/2, 3

[56] References Cited

U.S. PATENT DOCUMENTS

| | | | |
|---|---|---|---|
| 247,000 | 9/1881 | Bath | 40/107 |
| 684,107 | 10/1901 | Rueger | 40/107 |
| 1,109,814 | 9/1914 | Bailey | 40/107 |
| 1,583,666 | 5/1926 | Crooker | 40/107 |
| 1,635,927 | 7/1927 | Curtis | 40/107 |
| 2,447,807 | 8/1948 | Lathop | 40/107 |
| 4,075,774 | 2/1978 | Day | 40/109 |
| 4,094,082 | 6/1978 | Cannarozzo | 40/120 X |
| 4,142,311 | 3/1979 | Lane | 40/120 X |
| 4,176,478 | 12/1979 | Brewer | 40/107 |

*Primary Examiner*—Gene Mancene
*Assistant Examiner*—Michael J. Foycik
*Attorney, Agent, or Firm*—John L. McGannon

[57] ABSTRACT

A calendar having a plate-like support adapted to be mounted in an upright or flat position. The support has a number of first strips having spaced, vertically aligned numerals thereon which indicate certain days of a month. The support has mounting means for removably positioning the strips in generally upright positions so that, when the strips are properly arranged on the support, the numerals on the strips will be in the proper positions to indicate the days of a particular month. A group of second strips with the months of the year printed thereon are used one at a time to indicate a particular month. Mounting portions on the support removably positions each of the second strips on the support. In one embodiment of the calendar, the support has a recess for storing the second strips which are not being used. In the first embodiment, the mounting portions are pegs which extend laterally from the flat front face of the support and are received in holes in the first strips. In a second embodiment of the calendar, the mounting portions are tabs which are stamped from the support and project laterally from the front face thereof for insertion into holes into strips. Other embodiments of the calendar are also disclosed.

7 Claims, 10 Drawing Figures

CALENDAR

This invention relates to improvements in calendars of the type having shiftable elements to permit a single numbers on the elements to be arranged to represent the days of all the months of a year.

BACKGROUND OF THE INVENTION

Calenders with shiftable parts to permit rearranging of the days of the month have been known in the past. However, for the most part, these calendars have not been simplified to the point where only seven strips with numerals thereon can be used for all days of all months of a year. The prior calendars have required additional structure to permit the calendars to be suitable for use and such additional structure has caused the cost of producing the calendars to be significant. In view of these drawbacks, a need has arisen for a calendar of this type which is simple in construction and has a minimum of parts and can be made with minimum expense.

SUMMARY OF THE INVENTION

The present invention satisfies the aforesaid need by providing an improved calendar having a plate-like support on which a number of strips containing numerals are removably mounted so that the strips can be shifted about depending upon the month of the year to be formed, yet the calendar of this invention can readily provide for months having 28, 29, 30 or 31 days. To this end, the present invention includes only seven strips for indicating the days of the month and six strips indicating the names of the months, there being a second strip used at any one time with the group of first strips and each second strip having the name or abbreviation of a month on each of its sides, respectively. The first and second strips can be mounted in any suitable manner on the support, such as by pegs or tabs which project laterally from the flat front face of the support and which are received in holes in the strips. In the alternative, the strips can be mounted by press-fitting or placement of the strips in recesses in the support. Also, Velcro, magnetic or other fasteners can be used, if desired. Provision can be made on the support for housing the second strips which are not in use so that they will be readily available when a change of the month ocurrs and will not be separated from the other strips and become misplaced or lost.

The primary object of this invention is to provide an improved calendar which has shiftable strips with indicia thereon and which can be arranged to represent the days of any of the months of the year by the shifting of only a limited number of first strips representing the days of the month and by using a second strip representing the name of the month.

Another object of the present invention is to provide a calendar of the type described wherein the calendar is made from a relatively few number of parts, is simple and rugged in construction and, can be made at minimum cost yet can be used by persons of all ages.

Other objects of this invention will become apparent as the following specification progresses, reference being had to the accompanying drawing for an illustration of several embodiments of the invention.

IN THE DRAWING

Figure 5:
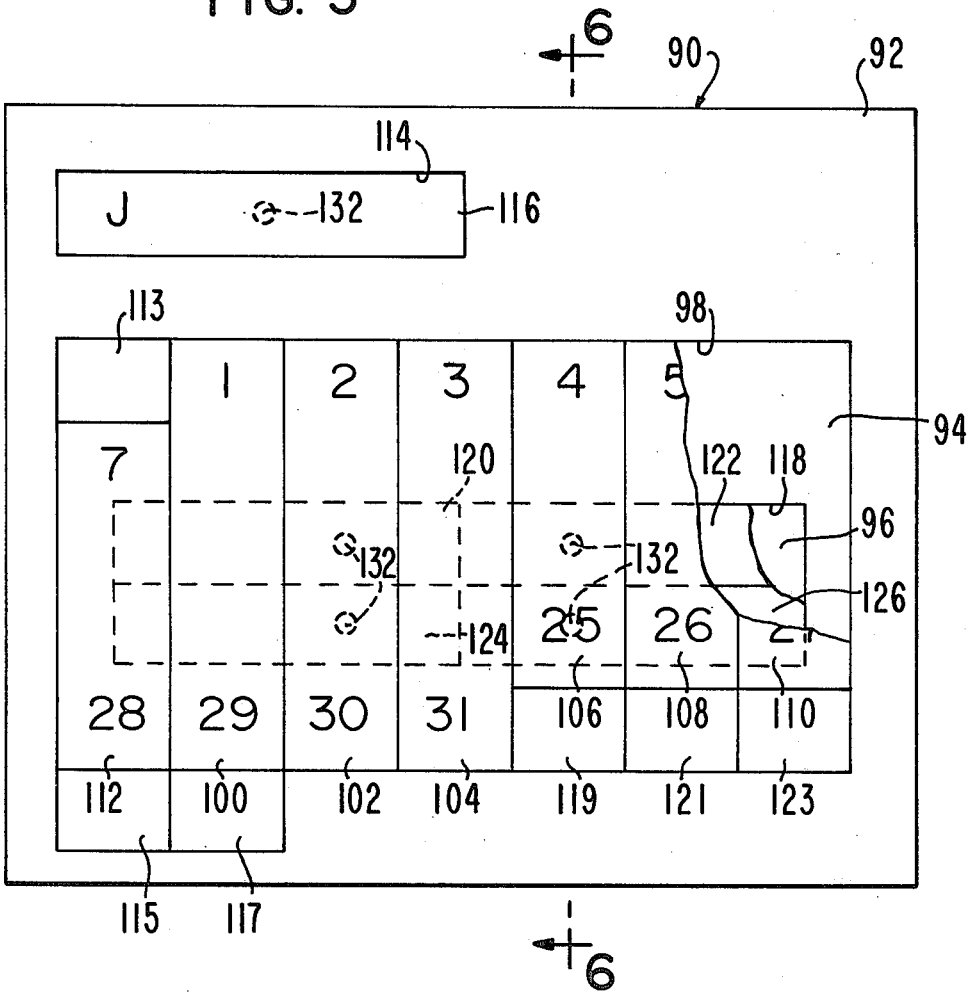
FIG. 5 is a view similar to FIGS. 1 and 3 but showing a third embodiment of the invention.
Figure 6:
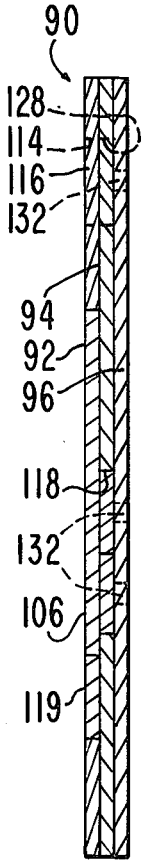
FIG. 6 is a cross-sectional view taken along lines 6—6 of FIG. 5.
Figure 6A:
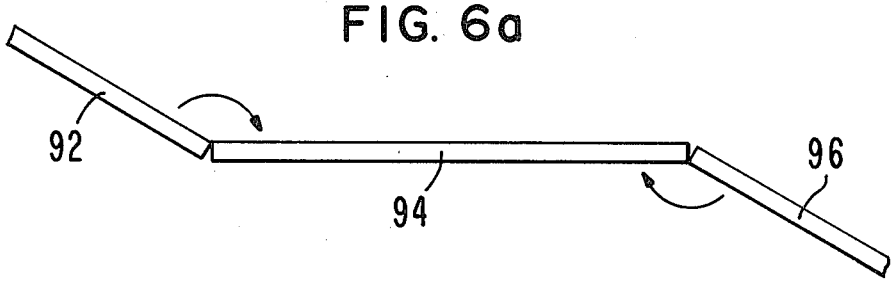
Figure 7:
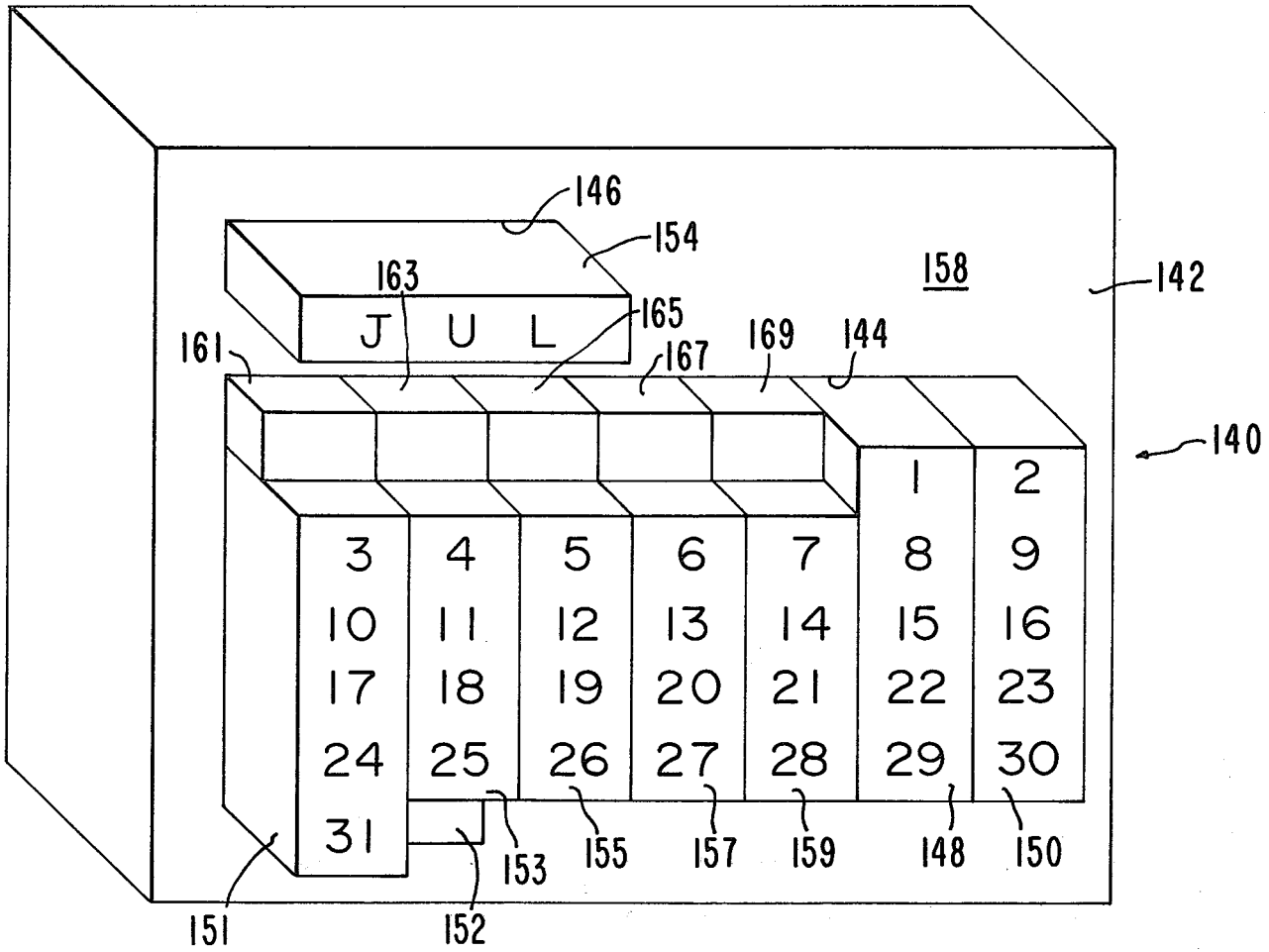
Figure 8:
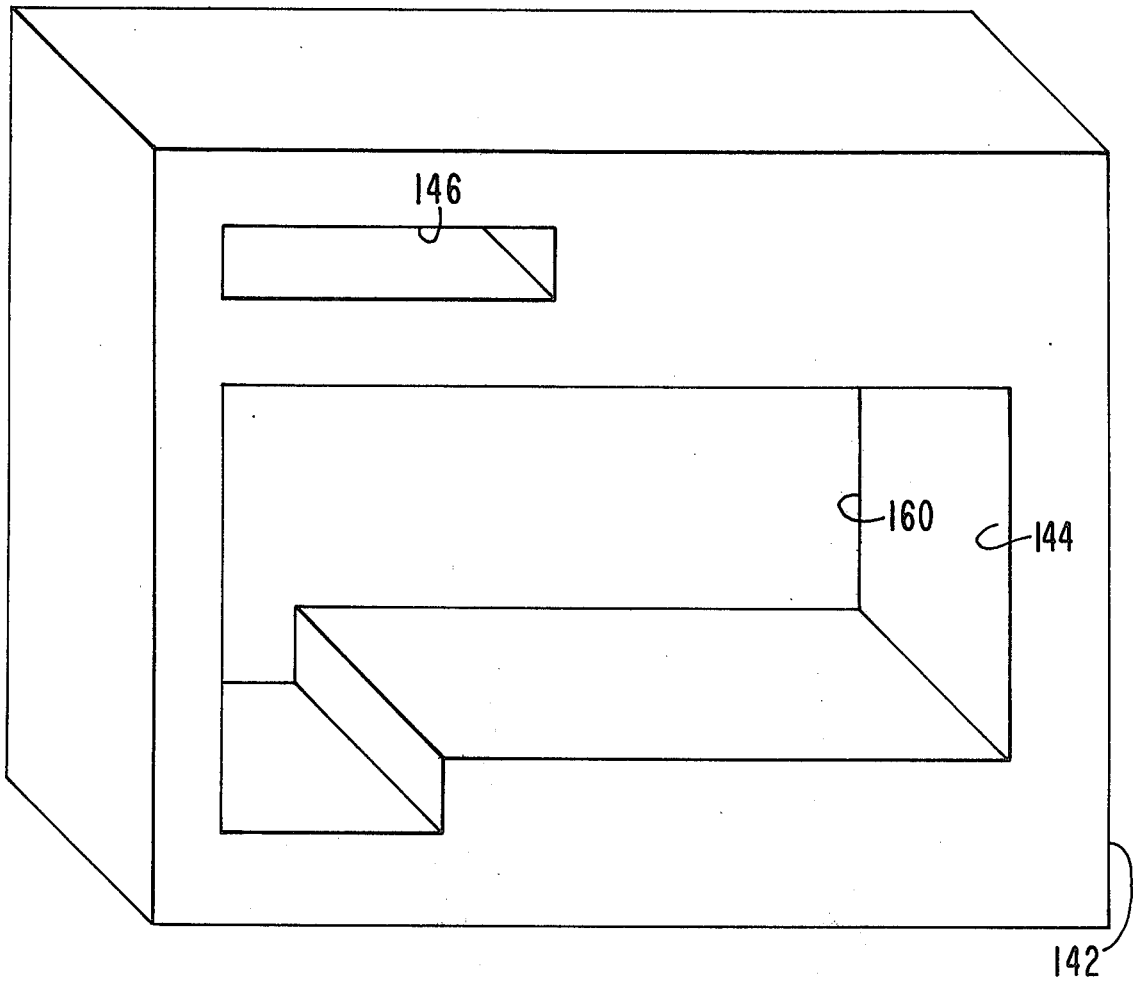
Figure 9:
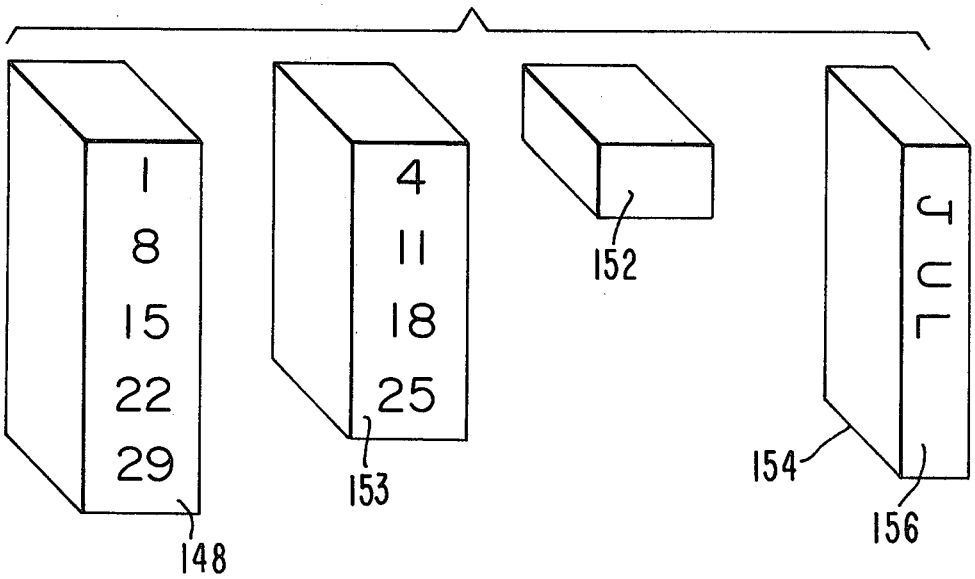

FIG. 6*a* is an improvement of the support of FIGS. 5 and 6;

FIG. 7 is a perspctive view of a fourth embodiment of the calendar of this invention using blocks on a support for the days of the month and the names of the months;

FIG. 8 is a view similar to FIG. 7 but showing the support with the blocks removed from it; and FIG. 9 is a composite, perspective view of the blocks for the embodiment of FIG. 7.

Figure 1:
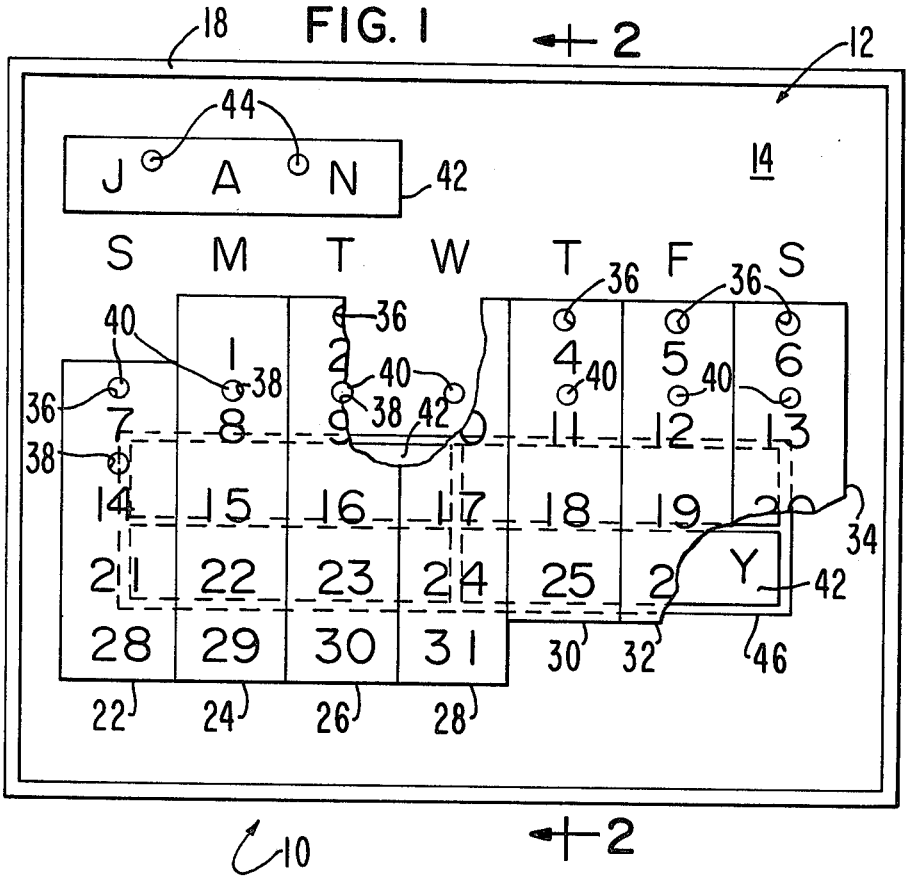
FIG. 1 is a front elevational view, partly broken away, of a first embodiment of the improved calendar of the present invention.
Figure 2:
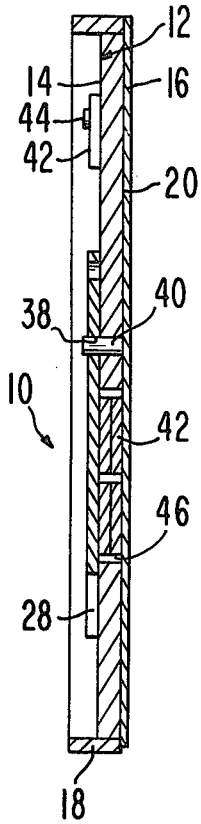
FIG. 2 is a cross-sectional view taken along line 2—2 of FIG. 1.
Figure 3:
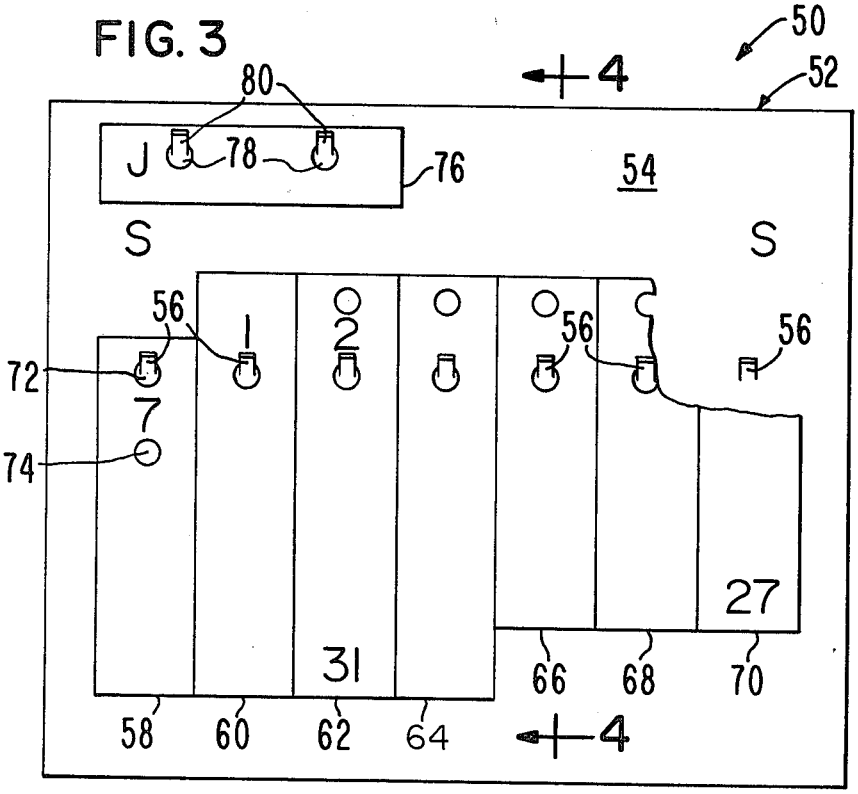
FIG. 3 is a view similar to FIG. 1 but showing a second embodiment of the calendar of this invention.

A first embodiment of the improved calendar of the present invention is broadly denoted by the numeral 10 and is illustrated in FIGS. 1 and 2. Calendar 10 includes a plate-like support 12 provided with a front flat face 14 and a rear flat face 16 (FIG. 2). Support 12 is generally rectangular but it can be of other shapes, if desired. Support 12 has an outer peripheral frame 18 surrounding and coupled to the outer peripheral margin of the support to provide an aesthetic appearance for the support. A thin sheet-like rear member 20 engages and covers the rear flat face 16 of support 12 as shown in FIG. 2.

Support 12 has a plurality of first strips 22, 24, 26, 28, 30, 32 and 34 on which are provided numerals 1 through 31 as shown in FIG. 1. These strips are generally rigid although rigidity is not a critical factor in the structure of the strips. Strips 22–34 are releasably coupled to front face 14 of support 12 and, to this end, each of the strips has a pair of vertically spaced holes 36 and 38, whereby each strip can be releasably mounted on a respective peg 40 secured to and extending outwardly from front face 14 as shown in FIG. 2. For purposes of illustration, each peg 40 is press-fitted into a hole in support 12, the thickness of the support being less than the length of peg 40 so that the peg can have a projecting portion which is received within a corresponding hole 36 or 38 of one of the strips 22–34. Two holes are provided in the shorter strips 22, 30, 32 and 34 because these strips can occupy either of two vertically spaced positions as hereafter described. Long strip 24 needs only one hole 38 but long strips 26 and 28 need two holes 36 and 38. Strips 22–34 are capable of being arranged so that they can provide the days of a month in accordance with the conventional arrangement of the seven days of the week denoted by the letters SMTWTFS in FIG. 1. By knowing which day the first day of a month falls on, the user of the calendar can quickly arrange the various strips 22–34 on pegs 40 so that the strips will provide at a glance all of the days of a particular month.

Strips 22, 30, 32 and 34 are all four numerals high; whereas, strips 24, 26 and 28 are five numerals high. For months which have 30 days, strip 28 is reversed and has the same numbers on its backside (not shown) as it does on its front side except that on its backside it does not have the numeral 31. Similarly, for the month of February having 28 days, strips 24 and 26 have numerals on their rear faces which are the same as on their front faces (FIG. 1) except that the back faces do not have numerals 29 and 30, respectively. A February month having 29 days can also be accomodated with calendar 10. In this way, any combination of 28, 29, 30 and 31 day months can be shown with the strips 22–34 of the present invention.

For indicating a particular month, a number of second strips 42 are provided, each second strip 42 having one or more holes for receiving pegs 44 on front face 14 of support 12. Typically, there are six second strips 42 with each second strip having lettering on its front and back faces for indicating two different months of the year. Thus, strip 42 as shown in FIG. 1 represents the month of January. On its back face it may have the abbreviation "Feb" to indicate the month of February. To change from one month to another, strip 42 is merely reversed on pegs 44 or replaced by another strip 42. The other strips 42 are contained in a recess 46 formed by removing a central portion of support 12. Member 20 closes the back part of the recess and strips 22–34 removably close the front portion of the recess.

In use, calendar 10 is typically mounted on a wall or table in any suitable manner. For instance, support 12 can be hung by a picture hanger to the wall; in the alternative, support 12 can rest on a support surface, such as a table top. The user shifts strips 22–34 around on front face 14 of support 12 until the numerals indicating a particular month have been properly positioned. The two holes in strips 22, 26, 28, 30, 32 and 34 permit these six strips to be elevated or lowered depending upon where their numerals fall in the arrangement for a particular month. For instance, the first of the month that may fall on a Saturday so that the arrangement of the strips will be, beginning with the left-hand strips, strips 26, 28, 30, 32, 34, 22 and 24.

The elements of calendar 10 can be made from any suitable material. For instance, the elements can all be made of wood, plastic, metal, fabric, ceramic or cardboard.

Figure 4:
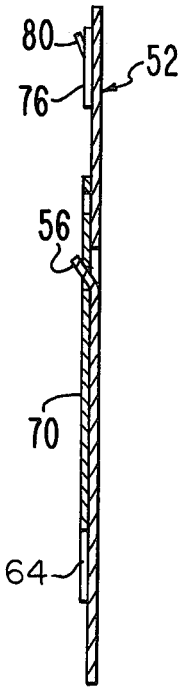
FIG. 4 is a cross-sectional view taken along line 4—4 of FIG. 3.

Another embodiment of the calendar of the present invention is broadly denoted by the numeral 50 and is formed from cardboard, plastic, metallic, ceramic or other suitable materials. Calendar 50 includes a support 52 having a flat front face 54 provided with tabs 56 which are stamped or otherwise formed so that the base of each tab 56 is integral with support 52 as shown in FIG. 4. The tabs project forwardly from front face 54 and provide peg means for mounting a plurality of first strips 58, 60, 62, 64, 66, 68 and 70, such strips 58–70 having numerals in the same manner as strips 22–34 of the embodiment of FIGS. 1 and 2.

Each of strips 60–70 has a pair of vertically spaced holes 72 and 74 which function in the same manner as holes 36 and 38 of each of strips 22–34. Strip 60 needs only one hole. Similarly, a plurality of second strips 76 are provided to indicate the months of the year, only one such second strip 76 being shown and such second strip is provided with a pair of spaced holes 78 for receiving a pair of tabs 80 formed in the same manner as tabs 56.

Calendar 50 is used in the same manner as calendar 10 in that strips 58–70 and strip 76 can be shifted on front face 54 to provide the necessary arrangement of indicia to indicate the days of a particular month of the year. Any suitable means can be provided to position or carry the remaining strips 76, such as a pocket formed on the rear face or in the interior of support 52.

Another embodiment of the calendar of the present invention is denoted by the numeral 90 and is shown in FIGS. 5 and 6. Calendar 90 is formed from three relatively rigid panels or sheets 92, 94 and 96 which may be cardboard or other similar material capable of being die-cut. Panel 92 is die-cut to present a recess 98 and a number of first strips 100, 102, 104, 106, 108, 110 and 112. These first strips are removably receivable in recess 98 and have the days of the month thereon. These first strips frictionally engage each other and are press-fitted into recess 98 to present the mounting means for the first strips. Six spacer members 113, 115, 117, 119, 121 and 123 are used with first strips 100–112 to fill the empty spaces of recess 98 for a particular arrangement of first strips. Thus, no other fastening means is required to keep the first strips removably positioned in recess 98. The height or length of each first strip is determined in the same manner as described above with respect to the strips in the embodiments of FIGS. 1–4.

Panel 92 is further die-cut to present a second recess 114 for receiving a second strip 116 containing the indicia representing a particular month. Strip 116 is also die-cut from panel 92 and is press-fitted in recess 114. Each side of second strip 116 represents a particular month.

Panel 94 is also die-cut to present a recess 118 and to form additional second strips 120, 122, 124 and 126 from recess 118. These additional second strips have indicia on opposed sides thereof representing respective months in the same manner as does strip 116. Additional recess 128 (FIG. 6) behind recess 114 is provided to form still another second strip 130 since there must be six second strips for the twelve months of the year. The second strips are removably press-fitted in the respective recesses, strip 116 representing the particular month in which the calendar is used, while strips 120, 122, 124, 126 and 130 are in stored positions and cannot be observed because they are in the plane of panel 94 which is behind panel 92.

Panel 96 may be provided with small holes 132 (FIG. 6) so that the fingers can be inserted through panel 96 and force the first and second strips and the spacer members out of respective recesses in panels 92 and 94. Thus, in changing from one month to the other, the fingers can force the first strips 100–112 out of recess 90 and force second strips 116, 120–126 and 130 out of recesses 114, 118 and 128, respectively. Then, the first and second strips and the spacer members can be rearranged and replaced in the respective recesses so as to set up the next month.

Calendar 90 can be mounted on a wall or on a table top whichever is desired. Moreover, panels 92, 94 and 96 can be formed from a single sheet of material and hingedly connected together in the manner shown in FIG. 6*a*. Another way of forming calendar 90 is to bind panels 92, 94 and 96 together in any suitable manner, such as by an adhesive or by staple-like fasteners.

FIG. 7 shows another embodiment of the calendar of this invention, the calendar being denoted by the numeral 140 and including a support 142 in the form of a block which, shown in FIG. 8, has a central, relatively large recess 144 and a smaller recess 146. Recess 144 is adapted to receive first strips or members 148, 150, 151, 153, 155, 157 and 159 as well as six spacers 152, 161, 163, 165, 167 and 169; whereas, recess 146 is adapted to receive a second strip or block-like bar 154 of which there are six in number, each bar 154 having a pair of opposed faces or sides 156 on which indicia representing a particular pair of months are placed. If bar 154 is square, the four side faces of the bar can receive indicia representing four particular months. In such a case, only three bars 154 are needed. The first and second strips, the spacers and the support can be of any suitable material and can be solid or hollow.

The first strips and spacers are arranged in the manner shown in FIG. 7 for a particular month. A particular second strip 154 is shown in recess 146. For purposes of illustration, the first and second strips project forwardly from the front face 158 of support 142; however, the first and second strips can have their front faces flush with front face 158, if desired. Additional second strips 154 can be stored in recess 144 to the rear of the recess. Recess 144 can extend only partially through support 142 or it can go all the way through. In the latter case, the rear opening 160 (FIG. 8) can be closed by a back sheet or cover to prevent the stored second strips 154 from falling out of recess 144. The bottom surfaces of recesses 144 and 146 are flat so that the first and second strips and spacers rest on the flat bottom surfaces to present the mounting means for the strips.

I claim:

1. A calendar comprising: a support including a number of abutting panels; a plurality of first strips, each first strip having first indicia thereon for indicating a particular group of days of a month; a set of second strips having second indicia thereon for indicating the months of the year, one of the panels having a first recess and a second recess, the first recess being adapted for removably receiving the first strips on the support in first locations in which the first strips are arranged to represent the days of a particular month with reference to the days of a week, the second recess being adapted for removably mounting a second strip on the support at a second location spaced from the first locations, each of said first and second strips having edge margins frictionally engageable with the support at the boundary of the respective recess for mounting the strip on the support, there being a number of spacer members for filling the first recess when the first strips are received therein.

2. A calendar as set forth in claim 1, wherein the material of a pair of said panels is capable of being die-cut, the first strips, one of the second strips and the spacer members being die-cut from a first of said pair of panels to form the first recess, the remaining second strips being die-cut from the second of said pair of panels to form a third recess and a fourth recess for storing the second strips.

3. A calendar as set forth in claim 2, wherein the second panel is between the first panel and a third panel.

4. A calendar as set forth in claim 2, wherein the panels are formed from a single sheet of said material and are hingedly interconnected.

5. A calendar comprising: a support including a block having a first recess and a second recess; a plurality of block-like members, each block-like member having first indicia thereon for indicating a particular group of days of a month, the block-like members being removably receivable in the first recess in first locations in which the block-like members are arranged to represent the days of a particular month with reference to the days of a week; and a set of block-like bars having second indicia thereon for indicating the months of the year; a block-like bar being removably receivable in the second recess, the second recess being spaced from the first locations, there being a spacer means for filling the first recess when the block-like members are received therein, the first recess having a size sufficient to store a number of the second strips behind the first strips when the latter are in the first recess.

6. A calendar as set forth in claim 5, wherein the second strips are generally square.

7. A calendar as set forth in claim 5, wherein four of the second strips can be stored in the first recess, the second recess being sufficiently large to contain a pair of second strips, one of the second strips being in a display positin in the second recess and the other second strip being in a stored position in the second recess.

* * * * *